United States Patent [19]

Mikan et al.

[11] Patent Number: 4,770,069

[45] Date of Patent: Sep. 13, 1988

[54] HAND-HELD CAP OPENER FOR CHILD RESISTANT CONTAINERS

[75] Inventors: Carl Mikan, Irwin, Pa.; Louis W. Matthey, Cincinnati, Ohio

[73] Assignee: Precise Metals & Plastics, Inc., East McKeesport, Pa.

[21] Appl. No.: 883,211

[22] Filed: Jul. 8, 1986

[51] Int. Cl.[4] ..... B67B 7/14

[52] U.S. Cl. ..... 81/3.55; 81/3.07

[58] Field of Search ..... 81/3.07, 3.09, 3.29, 81/3.4, 3.55, 3.57, 3.48

[56] References Cited

U.S. PATENT DOCUMENTS

| | | | |
|---|---|---|---|
| 2,291,866 | 8/1942 | Bethke | 81/3.55 |
| 2,330,893 | 10/1943 | Hutaff, Jr. | 81/3.55 |
| 3,885,477 | 5/1975 | Shook | 81/3.09 |
| 3,885,478 | 5/1975 | Evans | 81/3.55 |
| 4,073,205 | 2/1978 | Silliman | 81/3.09 |
| 4,178,646 | 12/1979 | Swartz et al. | 81/3.48 X |
| 4,433,597 | 2/1984 | Rowland | 81/3.09 |
| 4,455,894 | 6/1984 | Roberts | 81/3.09 |

*Primary Examiner*—Debra Meislin
*Attorney, Agent, or Firm*—Sughrue, Mion, Zinn, Macpeak & Seas

[57] ABSTRACT

A hand-held cap opener fitting the palm of the hand is employed in removing a cap from the child resistant container. The container terminates in a cylindrical neck having threads thereon and a first indicia at a circumferential position providing unlocking of the cap with the cap rotated to a corresponding angular position. The cap includes a radially outward second indicia projection. With the cap radial projection and the first indicia in circumferential alignment, the cap may be pried off the threaded end of the container neck. The cap opener is preferably of molded plastic and unitary form including a palm-held flat plate having top and bottom surfaces. A ring integral with the plate projects from the bottom surface with the ring sized slightly larger than the diameter of the cap which is received therein. An opening in the ring at the longitudinal center line of the flat plate receives the second indicia projection on the cap. Rotation of the cap opener flat plate causes the cap projection to contact the side of the opening in the ring to thereby facilitate rotation of the cap to align the indicia projection on the cap with the indicia on the container neck. Depression on the plate to the rear of the ring, diametrically opposite the opening in the ring receiving the cap projection permits the plate to act as a lever to snap the cap from the container neck. A hole in the plate aligned with the hole in the ring permits viewing of the projection on the ring as captured within the ring hole. The edge of the ring remote from the plate may be beveled downwardly in a direction away from the hole in the ring receiving the cap projection to facilitate entry of the cap within the ring and engagement with the cap opener.

6 Claims, 1 Drawing Sheet

FIG. 1
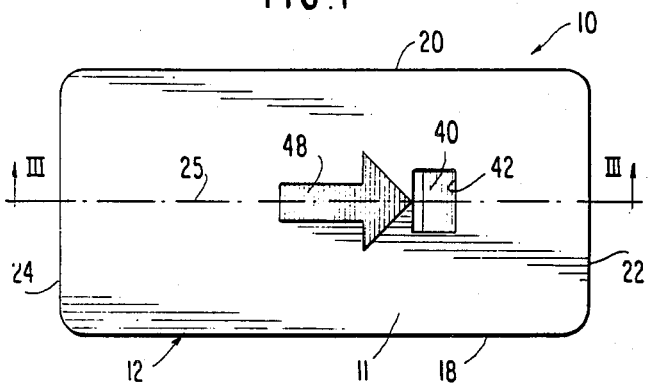
FIG. 4
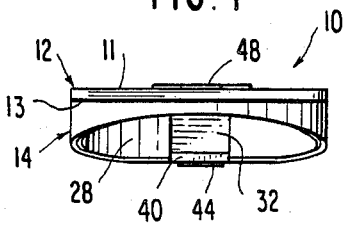
FIG. 2
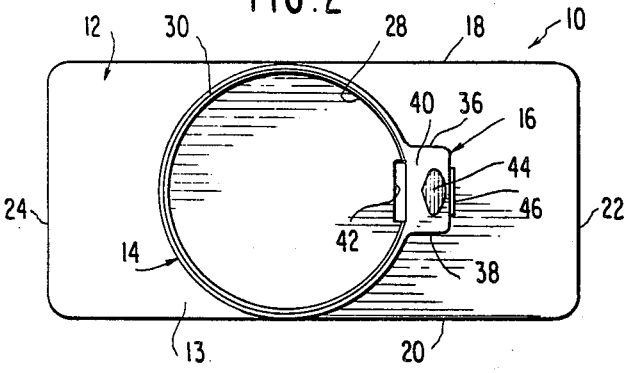
FIG. 5
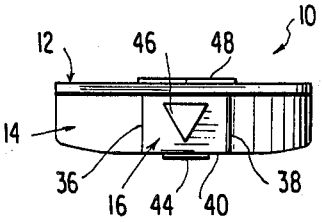
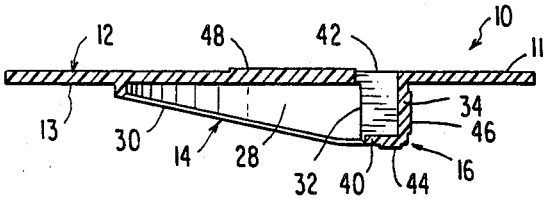
FIG. 3
FIG. 7
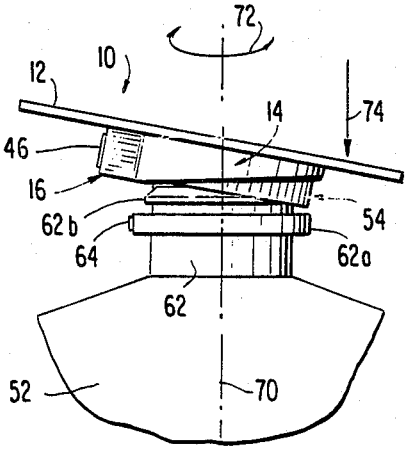
FIG. 6
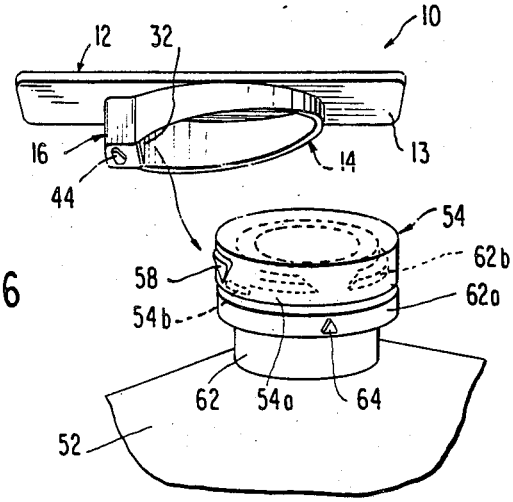

HAND-HELD CAP OPENER FOR CHILD RESISTANT CONTAINERS

BACKGROUND OF THE INVENTION

Child resistant containers for poison and prescription drugs are mandatory in the commercial sale of those compositions. Typically, child resistant containers involve a threaded cylindrical cap which in turn is threaded to the threaded end of a cylindrical container neck. By rotation of the cap to a particular circumferential position on the container neck, the cap may be pried off where the threads of the cap and container neck are misaligned. Further, significant frictional forces lock the cap to the container neck and there is significant resistance to prying the cap off. Further, such caps are narrow and difficult to grasp. This purposely makes it difficult for children to open the container. Normally adults have no trouble in rotating the cap to the release or unlocked position and are guided in that rotation by alignment of a first indicia on the neck of the container with a second indicia on the cylindrical cover. Typically, the indicia on the container neck is a radial projection in the form of triangle or arrowhead which points upwardly toward the upper end of the neck and in turn the indicia on the cap is a similar radial projection of inverted triangular form, pointing downwardly.

Difficulty in opening the container and removing the cap occurs for adults who are ill or have physical handicaps, particularly those having arthritis.

Tests have been made to provide child resistant container openers and to provide openers which have additional functions. U.S. Pat. No. 4,073,205 issued Feb. 14, 1978, is typical of such container ap or cover opener. The container opener of that patent comprises a planar molded plastic body of rectangular form having a V-notch or recess therein with serrations on the diverging notch surfaces at one longitudinal edge, while its opposite longitudinal edge is provided with a cutting blade. An alignment wall aligns the cap of the container to the serrated diverging walls of the notch and the cap of the container is inserted into the notch, the cap is pressed against the friction means and the planar body is rotated while being palm-held to circumferentially align the indicia of the cap with that of the container neck so as to unlock the cap from the container neck. The opener is then detached from the cap and the cap is removed by inserted and twisting the blade between the cap and the container neck.

Other patents directed to solving this or related problems are U.S. Pat. Nos. 4,178,646 issued Dec. 18, 1979; 4,455,894 issued June 26, 1984; 4,433,597 issued Feb. 28, 1984; and 3,885,478 issued May 27, 1975.

While such container cap or cover openers have assisted in the aligning and pry opening of a cap or cover from a tubular container or a neck bottle or the like, such openers as exemplified by U.S. Pat. No. 4,073,205, for instance, require the opener to be coupled to the cap or cover to perform one of the necessary steps such as alignment of the cap by rotation with the container proper or the threaded neck portion of a bottle and then the removed and different orientation for prying the unlocked cover or cap from the receptacle itself. Further, the openers as exemplified by the other patents are highly complex, expensive to manufacture and some have the same problems as U.S. Pat. No. 4,073,205.

It is, therefore, a primary object of the present invention to provide a unitary, molded plastic cap opener which may be palm operated, provides a high degree of leverage in prying a cap off of a container and which facilitates rotation of the cap and circumferential alignment of indicia carried by the cap and container to cap unlocked position and which, remains in the same position on the cap to easily, effectively snap the cap off the container with highly leveraged minimal force.

SUMMARY OF THE INVENTION

The invention is directed to a hand-held cap opener for a child resistant container to facilitate the unlocking and removing of a cylindrical, internally threaded cap to a cylindrical necked container having cooperating external threads thereon. The container neck has a first indicia thereon at a cap rotation unlock position and said cap has a radially outward second indicia projection on the periphery thereof at a circumferential position corresponding to cap unlock position, thereby permitting said cap to be pried off the threaded end of the container neck. The cap opener comprises a unitary palm-held flat plate having top and bottom surfaces, a ring integral with the plate and projecting outwardly of the bottom surface of the plate. The ring has an internal diameter sized slightly larger than the diameter of the cap to receive the cap, and a hole within the ring such that, said ring may be placed on the cap with the radial projection on the cap received within the hole in the ring whereby, by palm rotation of the plate, the cap projection abuts the ring to the side of the hole causing the cap to rotate with the plate to align the first indicia on the neck to the projection of the cap. Depression of the palm against the top surface of the plate to the side diametrically opposite from the hole in the ring results in highly leverage force application on the cap to snap the unlocked cap from the container neck.

The flat plate may have a second hole therein circumferentially aligned with the ring hole and projecting outwardly of the ring to permit viewing of the second indicia projection within the ring hole from the top surface of the palm-held flat plate. Preferably, the edge of the ring remote from the flat plate is beveled toward the flat plate in the direction away from the ring hole to facilitate entry of the container cap into the interior of the ring. The palm-held flat plate may be of elongated rectangular plan form having a longitudinal center line with the hole in the ring aligned therewith and the ring centered longitudinally on the palm-held flat plate. The cap opener may be of molded plastic and the opener may include an integral rectangular box-like receptor extending radially outwardly of the ring comprised of a radially outer wall, a bottom wall and opposed side walls and being open at the top, forming said hole within said palm-held flat plate, and having an radially internal opening forming said hole within said ring. Arrow indicia may be carried on the bottom wall and radially outer wall of the box-like receptor and on said top wall pointing to the position of the radial second indicia projection of the cap readily viewed through the hole within the flat plate.

BRIEF DESCRIPTION OF THE DRAWINGS

FIG. 1 is a top plan view of the hand-held cap opener for child resistant containers forming a preferred embodiment of the invention.

FIG. 2 is a bottom plan view of the opener of FIG. 1.

FIG. 3 is a longitudinal sectional view of the opener of FIG. 1 taken about line III-3.

FIG. 4 is a rear elevational view of the opener of Figure 1.

FIG. 5 is a front elevational view of the opener of FIG. 1.

FIG. 6 is an exploded perspective view of the opener being applied to container cap prior to rotation of the cap to alignment position.

FIG. 7 is a perspective view similar to that of FIG. 6 during snap opening of the cap after rotation of the cap to cap and container indicia alignment and cap unlocking position.

DESCRIPTION OF THE PREFERRED EMBODIMENT

The hand-held cap opener for child resistant containers is indicated in the drawings at 10 and is preferably of one piece molded plastic material. The opener 10 is formed of three major components, a thin, flat actuator plate 12 generally of elongated rectangular plan form, a cap or cover capture ring indicated generally at 14, integral with the plate 12, projecting outwardly from bottom surface 13 thereof at right angles thereto, of a diameter on the order of a width of the plate 12 and being centered thereon; and a box-like, cap projection receptor 16. These components are all integrally molded and the cap projection receptor 16 constitutes an integral, radial projection of the capture ring 14.

The actuator plate 12 has a top surface 11 and a bottom surface 13, opposed side edges 18, 20, a forward or front edge 22 and a rear edge 24. The capture ring 14 is centered on the longitudinal centerline 25 and the cap projection receptor 16 is also centered on that centerline. Receptor 16 constitutes a radial projection of the ring 14, projecting outwardly of the ring wall 28 in the direction of the forward edge 22. Further, the ring annular wall 28 has a tapered or beveled outer edge 30 remote from the actuator plate 12. Edge 30 tapers in the direction of the bottom surface 13 of plate 12 away from the cap projection receptor 16 with the lowest point of the annular wall 28 of ring 14 at the centerline 25 and proximate to the rear edge 24 of the actuator plate 12. Cap projection receptor 16 is of parallelpiped form, that is of rectangular plan configuration and includes a vertical front or radially outer wall 34, laterally opposed vertical sidewalls 36, 38 and a horizontal bottom wall 40. Additionally, while receptor 16 is integral with ring 14, the ring annular wall 28 is provided with a rectangular hole 32 which opens to the interior of the cap projection receptor 16. Similarly, the actuator plate 12 is provided with a rectangular window or hole 42 which is of a lateral width equal to the distance between the sidewalls 36, 38 of the cap projection receptor 16, bisects the longitudinal centerline 25 and opens to the interior of the receptor 16.

Preferably, the cap opener includes a number of arrow-like indicia acting as visual guides to facilitate the use of the opener in opening the cap or cover of a container or receptacle bearing the same. In that respect, as seen in FIG. 2, a first arrowhead symbol 44 on receptor bottom wall 40 points in the direction of the interior of the ring 14 and away from the front edge 22 of the actuator plate. As seen in FIG. 5, a second arrowhead symbol 46 is molded into the front wall 34 of the cap projection receptor 16 and it points downwardly in the direction of pressure application against the cap or cover of the receptacle or container to be applied thereto. The third symbol or indicia is at 48, FIG. 1, and is a relatively large arrow whose pointed end is proximate to the rectangular window or hole 42 within the actuator plate, permitting viewing of the interior of the cap projection receptor 16, when placed on the cap.

The cap opener 10 of the present invention is illustrated in use as opening or removing a cap or cover indicated generally at 54, FIGS. 6 and 7, which is threadably locked to a corresponding necked container or bottle 52. In the illustrations, container 52 takes the form of a bottle having a threaded neck 62 to which cap 54 is coupled. As mentioned previously, the cap 54 which may also be of molded plastic, is of cup form, having a short length cylinderical portion **54*a* threaded internally. An arrowhead shape projection 58 projects radially outwardly of cap cylindrical portions 54*a*, pointing downwardly toward the container or bottle 52 bearing the same. The neck portion 62 of the bottle is shown as including a radially outwardly projecting collar 62*a* from which an integral arrowhead projection 64 extends, constituting a first indicia at a given circumferential point relative to the threads 62*b* of the bottleneck 62. Whereas, the oppositely directed arrowhead projection 58 of the cap 54 constitutes a second indicia relative to the circumferential positioning of the threads 54*b* internally of the cylindrical portion 54*a* of cap 54. This arrangement for locking the cap to the threaded neck 62 of container or bottle 52 is standard in the industry. By suitably rotating the cap or cover 54 to the position where the projections 58 and 64 are circumferentially aligned, the threads 62*b* of the container 52 are located at the gaps between the thread 54*b* carried by the cap 54 and the gaps between the thread 54*b* of container 52 confront the threads 62*b* of the container. In this position, the cap can be snapped off the top of bottle 52. FIG. 6 illustrates the nature of the mounting the hand-held and palm grasped cap opener 10 onto and pressed downwardly against the cap 54 of the container 52. As indicated by arrow 72, the plate 12 is rotated in either direction until the cap second indicia projection 58 (captured in receptor 16) is aligned with the projection or like first indicia 64 on the container neck 62. In effecting that rotation, the projection 58 acts as a fulcrum in that it abuts either sidewall 36 or sidewall 38 of the cap projection receptor 16 to drive the cap and thus, the cap is circumferentially rotated about axis 70, FIG. 7, to the point where the projection 58 is aligned with that at 64**.

The cap is now in a proper position for frictional disengagement from the container neck 62. Disengagement is achieved by pressing downwardly onto the top surface 11 of the actuator plate 12 adjacent the rear edge 22 of that member as indicated by arrow 74, FIG. 7, causing the front edge of the cap 54 at projection 58 to flip upwardly and effecting a quick snap removal of the cap 54 from the container 52. The actuator plate provides excellent leverage and little force is required to achieve this result. The actions in opening of cap may be accomplished easily by persons who are relatively weak, who are quite ill, who are handicapped or who have a debilitating disease such as arthritis and who, in the past have found it virtually impossible to remove such caps from child resistant containers such as container 52.

While the device has been described as being of molded plastic and of unitary construction, it may constructed otherwise and it may differ slightly in form. However, the device requires at least the actuator plate, the incorporation of the ring 14 and the placement of a hole 32 within the annular wall 28 of the ring in a position capable of receiving the cap projection 58 in order to accomplish the result intended.

While the invention has been described in detail with respect to specific embodiments thereof, it will be apparent to one skilled in the art that modifications and changes can be made therein without departing from the spirit and scope thereof.

What is claimed is:

1. A palm-operated, hand-held cap opener for a child resistant container to facilitate the unlocking and removing of a cylindrical, internally threaded cap from a cylindrical neck container having cooperating external threads thereon, said container neck having a first indicia thereon at a cap rotation unlock position and said cap having a radially outward second indicia projection on the periphery thereof at a circumferential position corresponding to the cap unlock position and permitting the cap to pried off the threaded end of the container neck, said cap opener comprising a unitary palm-held flat plate having top and bottom surfaces, a ring integral with said plate and projecting outwardly of the bottom surface thereof, said ring having an internal diameter sized slightly larger than diameter of the cap, to receive the cap, a hole within the ring sized in excess to the radially outward projection of the cap, and means forming a bottom wall extending outwardly from said ring and partially defining said hole such that the ring may be placed about the cap within the plate pressing downwardly on the cap and the radially outward projection positioned within the hole in the ring and overlying said bottom wall, whereby, upon palm rotation of the plate, the cap radially outward projection abuts the ring to the side of the hole therein, causing the cap to rotate with the plate to align the first indicia on the container neck to the radially outward second indicia projection of the cap while subsequently, depression of the palm against the top surface of the plate at a point diametrically opposite from the hole in the ring results in a highly leveraged force application on the cap to cause the bottom wall to engage an underside surface of the cap to snap the unlocked cap from the container neck, and wherein said flat plate has a hole therein in circumferential alignment with the hole in the ring and projecting outwardly away from the ring to form a window permitting viewing of the cap second indicia projection within the ring hole from the top surface of the palm-held flat plate.

2. The hand-held cap opener as claimed in claim 1, wherein the edge of the ring remote from the flat plate is beveled toward the flat plate in a direction away from the ring hole to facilitate entry of the container cap into the interior of the ring.

3. The hand-held cap opener as claimed in claim 1, wherein said palm-held plate is of elongated rectangular plan form of a length approximately twice its width and of a width on the order of the diameter of said ring and wherein the ring is centered longitudinally on the palm-held plate with the hole in the ring aligned with the longitudinal centerline of the palm-held flat plate.

4. The hand-held cap opener as claimed in claim 1, further comprising an integral, rectangular, box-like receptor extending radially outwardly of the ring and surrounding the hole in the ring and comprising a radially outer wall, said bottom wall and opposed sidewalls and being sized slightly larger than the cap and said radially outward second indicia projection being receivable therein through said hole within said ring.

5. The hand-held cap opener as claimed in claim 4, wherein, said rectangular, box-like receptor is further open at the top defining a hole within said palm-held flat plate functioning as a window to permit viewing of the cap projection therein from the top of the plate when said opener is coupled to a container cap.

6. The hand-held cap opener as claimed in claim 5, further comprising indicia on said bottom wall, radial outer wall of the box-like receptor and on said top wall, all pointing to the position of the radially outward second indicia projection of the cap within the hole within the ring and within the interior of the receptor.

* * * * *